US012203332B2

(12) United States Patent
Lund et al.

(10) Patent No.: US 12,203,332 B2
(45) Date of Patent: Jan. 21, 2025

(54) OIL WELL STUFFING BOX

(71) Applicant: ConocoPhillips Company, Houston, TX (US)

(72) Inventors: Hans-Jacob Lund, Houston, TX (US); Daniel Fish, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 18/138,358

(22) Filed: Apr. 24, 2023

(65) Prior Publication Data

US 2023/0340853 A1 Oct. 26, 2023

Related U.S. Application Data

(60) Provisional application No. 63/333,794, filed on Apr. 22, 2022.

(51) Int. Cl.
*E21B 33/08* (2006.01)
*E21B 43/12* (2006.01)

(52) U.S. Cl.
CPC ..... *E21B 33/08* (2013.01); *E21B 43/127* (2013.01)

(58) Field of Classification Search
CPC ..... E21B 33/08; E21B 33/085; E21B 43/126; E21B 43/127
See application file for complete search history.

(56) References Cited

U.S. PATENT DOCUMENTS 2,567,479 A * 9/1951 Hebard ..... E21B 33/08 277/504
4,560,176 A 12/1985 Hoff
4,986,511 A * 1/1991 Irby ..... E21B 33/06 277/944
5,058,668 A * 10/1991 Newton ..... E21B 33/08 166/170
5,803,169 A 9/1998 Bassinger et al.
6,637,509 B2 * 10/2003 Farquharson ..... F04B 53/164 166/241.2
2006/0032635 A1 * 2/2006 Rivard ..... E21B 43/126 166/287
2008/0190599 A1 8/2008 Arnold
2017/0204974 A1 7/2017 Ruffin et al.
(Continued)

FOREIGN PATENT DOCUMENTS

GB 714185 A 8/1954
WO WO-9503504 A1 2/1995

OTHER PUBLICATIONS

International Search Report and the Written Opinion for International Application No. PCT/US2023/019579 dated Jul. 19, 2023 (10 pages).

*Primary Examiner* — David Carroll
(74) *Attorney, Agent, or Firm* — Polsinelli PC

(57) ABSTRACT

Implementations described and claimed herein provide apparatus and techniques for providing a seal for a polished rod. One example apparatus is a stuffing box. The stuffing box generally includes: a first flange configured to surround a polished rod; a second flange configured to surround the polished rod; a seal package disposed between the first flange and the second flang, the seal package being configured to surround and connect to the polished rod; and a flexible membrane surrounding the seal package, the flexible membrane being connected to at least a portion of the seal package.

20 Claims, 10 Drawing Sheets

(56) References Cited

U.S. PATENT DOCUMENTS

| | | | | |
|---|---|---|---|---|
| 2019/0017342 | A1 | 1/2019 | Yu et al. | |
| 2020/0399972 | A1 | 12/2020 | Yu et al. | |
| 2022/0145719 | A1* | 5/2022 | Semlinger | E21B 33/03 |

* cited by examiner

OIL WELL STUFFING BOX

CROSS-REFERENCE TO RELATED APPLICATIONS

The present application claims priority to U.S. Provisional Patent Application No. 63/333,794 filed on Apr. 22, 2022, which is incorporated by reference in its entirety herein.

FIELD

Aspects of the present disclosure generally relate to a systems and methods for reducing well leaks during production, and more particularly, to a stuffing box for an oil well, with the stuffing box including a flexible membrane connected to a seal package.

BACKGROUND

Stuffing boxes may be used during production at a well to prevent oil, water, and gases produced under pressure by a pumping system from escaping into the atmosphere. During production, leaks may sometimes occur, with many of those leaks at a well during production involving stuffing box spills. Exacerbating these issues, seals in conventional stuffing boxes experience high incidence of wear and tear, necessitating frequent maintenance to reduce leakage, thereby increasing operating costs. It is with these observations in mind, among others, that the presently disclosed technology was conceived and developed.

SUMMARY

Implementations described and claimed herein address the foregoing by providing systems and methods for providing a seal for a polished rod. In some aspects, the techniques described herein relate to a stuffing box. The stuffing box generally includes: a first flange configured to surround a polished rod; a second flange configured to surround the polished rod; a seal package disposed between the first flange and the second flange, the seal package being configured to surround and connect to the polished rod; a flexible membrane surrounding the seal package, the flexible membrane being connected to at least a portion of the seal package.

In some aspects, the techniques described herein relate to a method for providing a seal for a polished rod. The method generally includes: supporting a flexible membrane between a first flange and a second flange, the first flange and the second flange surrounding the polished rod; supporting a seal package via the flexible membrane connected to at least a portion of the seal package; and providing a seal around the polished rod via the seal package, the seal package being disposed between the first flange and the second flange.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
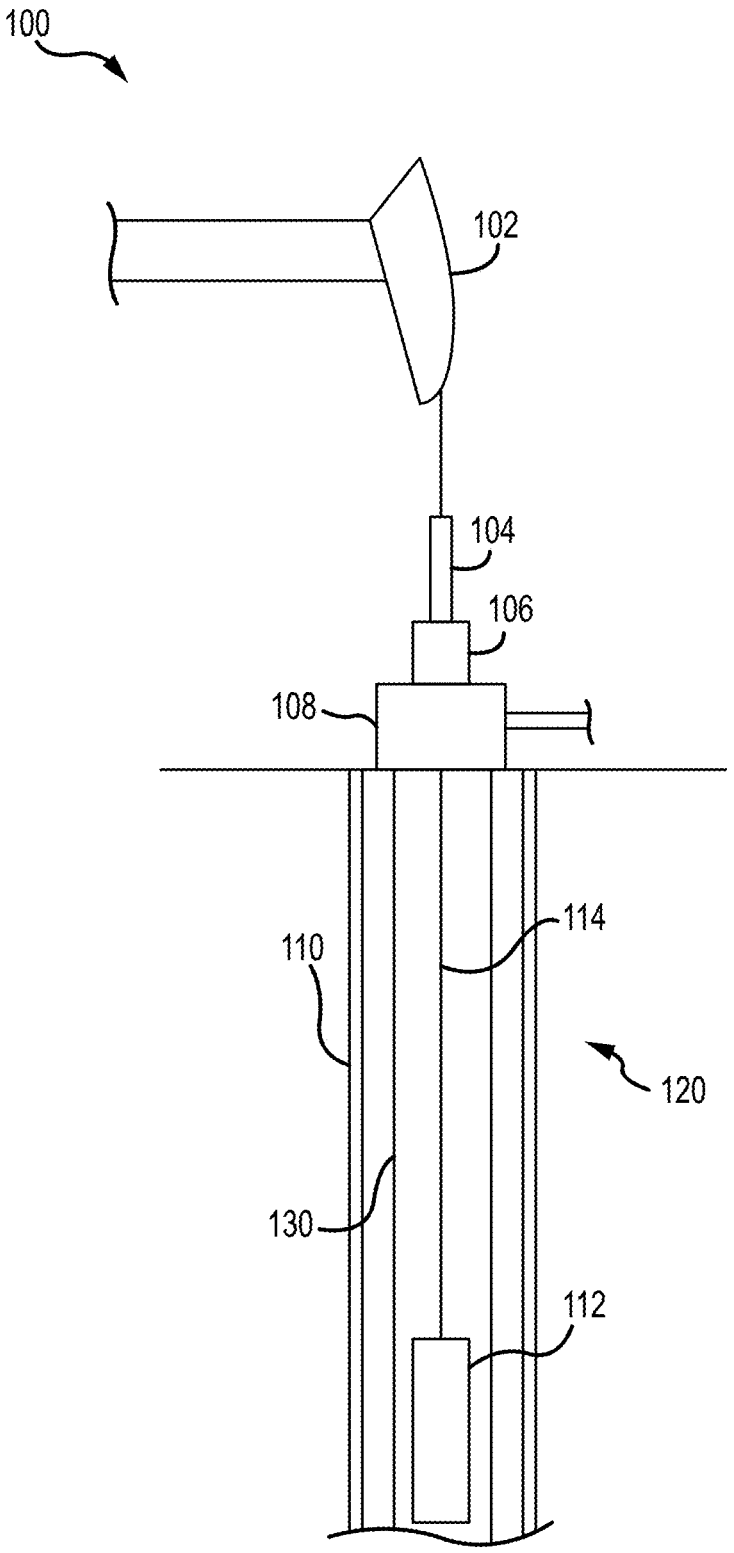
FIG. 1 is an example rod pumping system for a well.

Aspects of the present disclosure are directed towards a stuffing box for providing a seal around a polished rod of a well pumping system. In conventional stuffing box implementations, high contact force is placed on sealing elements against a polished rod to ensure a strong seal. However, such a high contact force increases the wear of the sealing elements. As a result, maintenance activities (e.g., seal replacement and lubrication) occur often, increasing operating costs. For example, the polish rod is generally not perfectly centralized and the polish rod tilts back and forth on each stroke in and out of a well, making it difficult to employ fixed seal packages from being employed. Thus, the seal packages may be compressed and deformed forcing the seal to contact the polish rod, creating a high contact force resulting in the seal material being worn down. As the seal material is worn down, additional compression is applied to maintain the seal.

Certain aspects of the present disclosure provide a stuffing box having a sealing package around a polished rod and flexible membrane connected (e.g., molded) to the outside perimeter of the sealing package. Supporting a sealing package on a flexible membrane allows the seal package to tilt along with the polish rod, reducing the high contact forces. Placing the membrane between two flanges allows for centralization of the seal package to the polish rod (e.g., rather than the wellhead) during installation, thus further reducing contact force. In this manner, the wear on the seal may be reduced resulting in a reduction of maintenance activities. In some aspects, the sealing package may include a polypack seal package, yet other suitable types of sealing elements may be used, such as an o-ring as described in more detail herein.

I. Terminology

In the description, phraseology and terminology are employed for the purpose of description and should not be regarded as limiting. For example, the use of a singular term, such as "a", is not intended as limiting of the number of items. Also, the use of relational terms are used in the description for clarity in specific reference to the figure and are not intended to limit the scope of the present inventive concept or the appended claims. Further, any one of the features of the present inventive concept may be used separately or in combination with any other feature. For example, references to the term "implementation" means that the feature or features being referred to are included in at least one aspect of the presently disclosed technology. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations but is not necessarily included. Thus, the presently disclosed technology may include a variety of combinations and/or integrations of the implementations described herein. Additionally, all aspects of the presently disclosed technology as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

FIG. 1 is an example rod pumping system 100 fora well 120. In one implementation, the well 120 has a borehole that extends from the surface into the earth. The borehole has a casing 110. A string of sucker rods 114 extend from a sucker rod pump 112 to a polished rod 104. The polished rod 104 is connected to the sucker rods 114 through a stuffing box 106 connected to a wellhead 108. A cable connects the polished rod to a pump jack unit 102. The pump jack unit 102 is used to drive a piston pump in the well 120. The pump jack unit 102 mechanically lifts liquid out of the well 120 if there is not enough bottom hole pressure for the liquid to flow to the surface. More particularly, the polished rod 104 moves up and down in a vertical plane to facilitate lifting the liquid from the well 120. The polished rod 104 moves up and down through the stuffing box 106. The stuffing box 106 may surround the polished rod 104 to guide or center the polished rod 104 for vertical reciprocal movement without escaping produced liquids or gases. The polished rod 104 is moved up and down by pump jack unit 102 to facilitate pumping of liquids from the well via sucker rods 114 and sucker rod pump 112. The rod pump 112 may be inside tubing 130 of the well 120. The stuffing box 106 may include various seals to prevent (or at least reduce) leakage of fluids or gases.

As described herein, many well leaks are caused by stuffing box leaks. A major challenge in preventing leaks is that the polished rod 104 tends to not only move up and down (e.g., vertically) through the stuffing box 106, but also move back and forth (e.g., horizontally) for every stroke. The polished rod 104 may also not be perfectly centered in the wellhead.

In some implementations, rubber sealing cups are implemented in the stuffing box 106, which are mechanically squeezed against the polished rod 104 in an attempt to force the rod to be straight and centered. The result is a high contact force on the sealing elements, increasing the wear of the sealing elements. To reduce friction, a lubricant (e.g., grease) may be injected in the stuffing box several times a week. As the seals are eroded by the polished rod, compression bolts may be tightened to squeeze the seals back into contact with the rod. For example, the compression bolts may be tightened every couple of days. After all this maintenance work, the seals still fail, all resulting in high maintenance costs Certain aspects of the present disclosure are directed to a stuffing box 106 implemented using a sealing package (e.g., a polypack seal package) connected (e.g., molded) to a flexible sealing membrane (e.g., a rubber disk). Since the seal package (e.g., poly pack seal package) may be unable to withstand high contact forces, a flexible membrane is connected to the polypack seal package from the outside of the polypack seal to the body of the stuffing box, preventing the escape of liquids and gases.

The membrane provides the flexibility to allow the polypack to seal against the polished rod without significant contact forces as the rod moves up and down while rocking back and forth. The membrane also provides a pressure seal on the outside of the seal package (e.g., poly pack).

Figure 2:
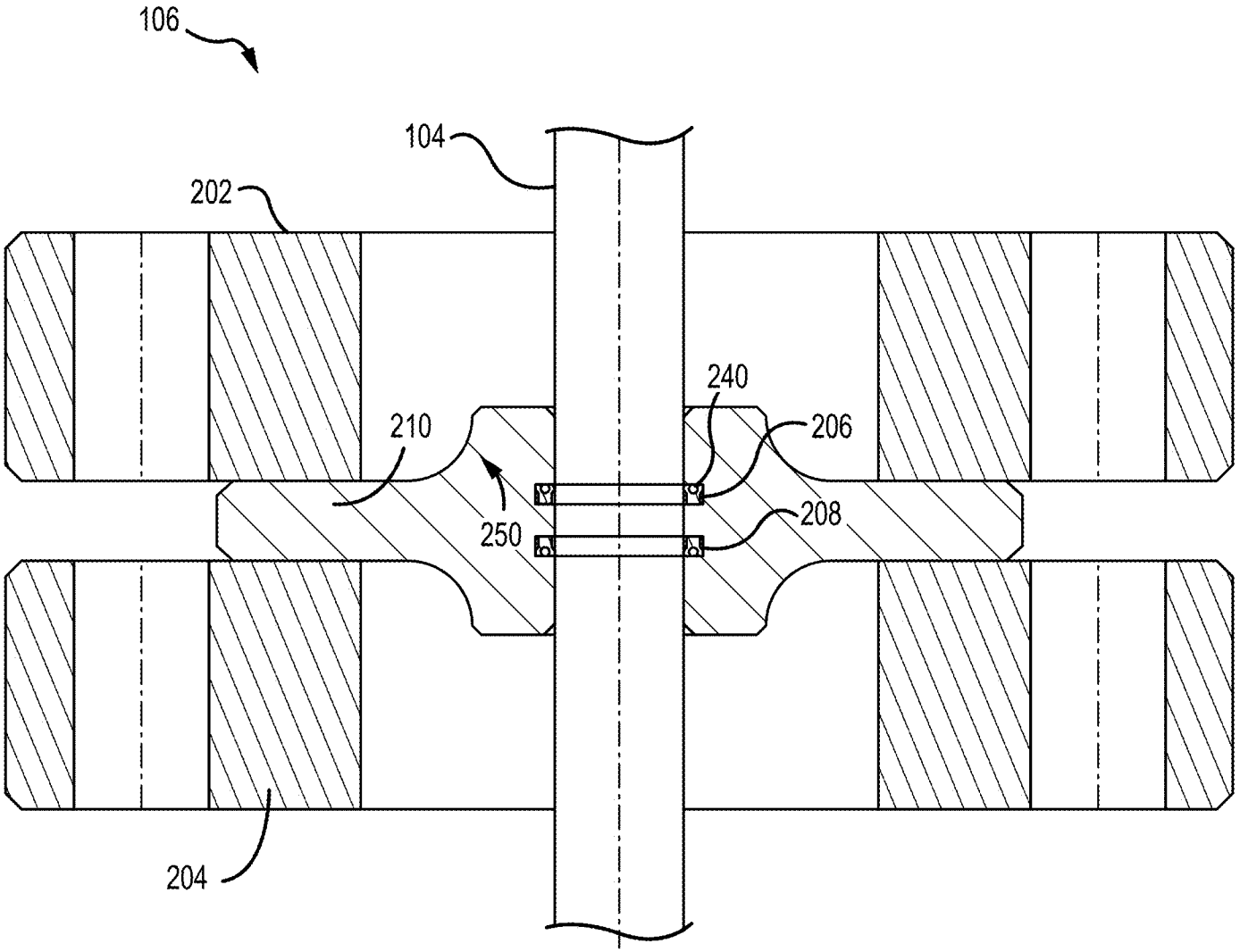
FIG. 2 illustrates a cross-section of an example stuffing box having a seal package connected to a flexible membrane.

FIG. 2 illustrates a cross-section of the stuffing box 106 having a flexible membrane connected to a seal package. As shown, the polished rod 104 extends through the stuffing box 106. The stuffing box 106 includes flanges 202, 204, which may be connected together via nuts and bolts (not shown).

Figure 3:
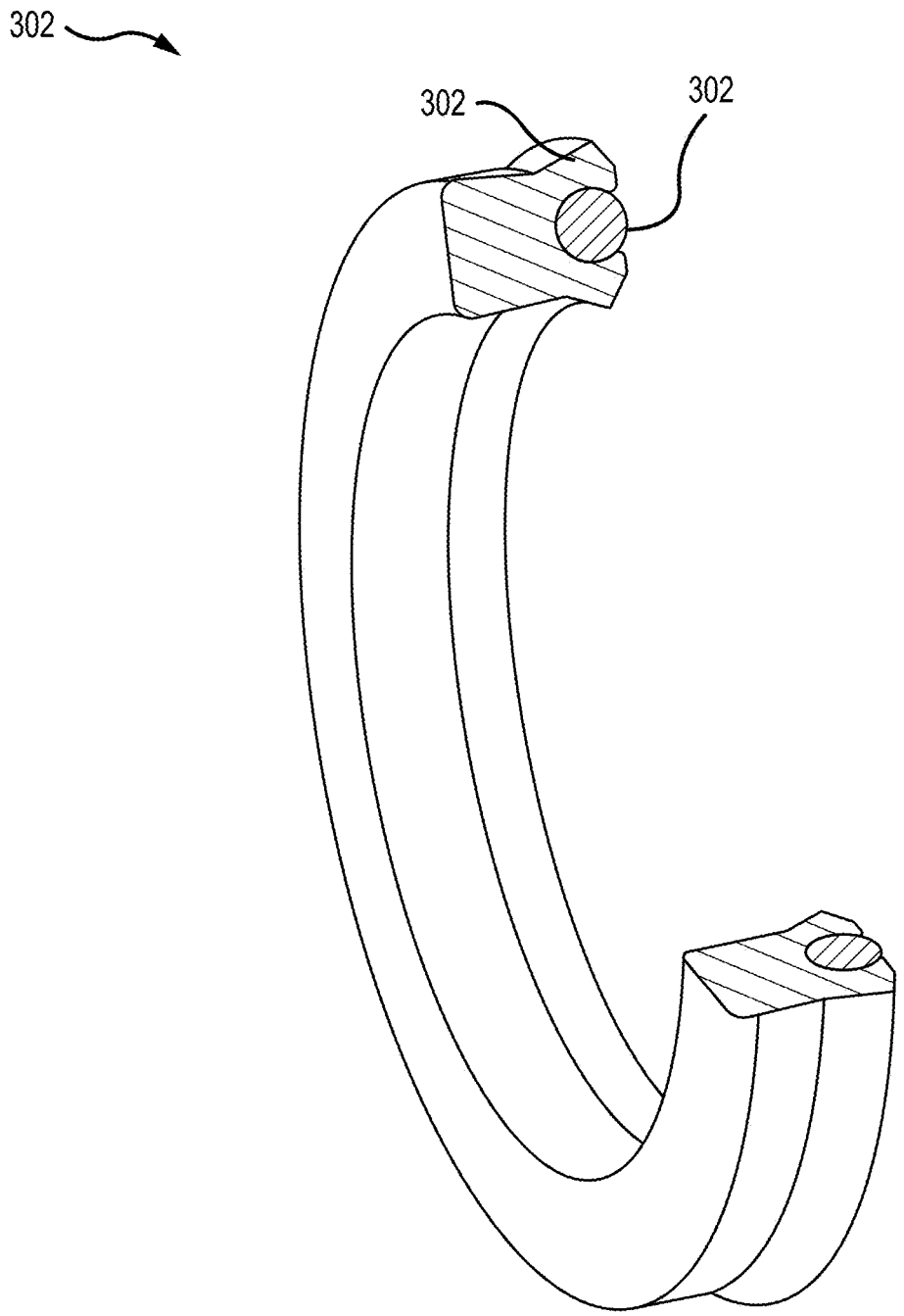
FIG. 3 illustrates a cross-section of an example a polypack seal.
Figure 4:
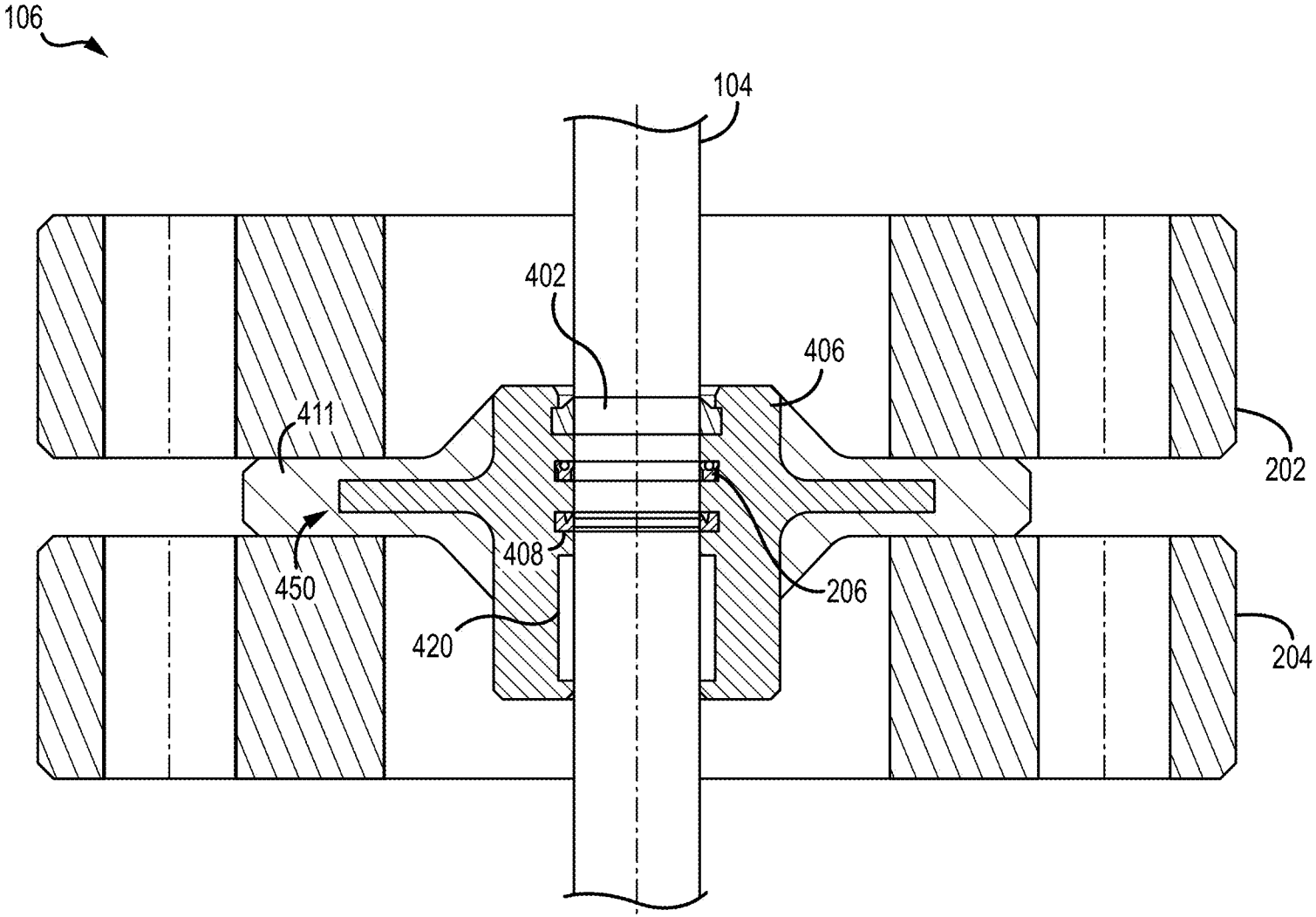
FIG. 4 illustrates a cross-section of a stuffing box having a polypack seal and one or more other sealing elements.

In some aspects, the seal package may include one or more polypack seals 206, 208, and a housing 210 (also referred to as a polypack housing) surrounding the polypack seals 206, 208. The housing 210 may include ridges in which the polypack seals 206, 208 fit, making a seal against the polished rod 104, as shown. The housing 210 has a curved shape portion 250 to fit between the flanges 202, 204 and the polished rod 104 such that the flanges 202, 204 support the housing 210 against the polished rod 104, as shown. The housing 210 provides a pressure seal from the outside of the polypack to the flanges 202, 204. FIG. 3 illustrates a cross-section of an example polypack seal 300. In one implementation, the polypack seal 300 provides a squeeze seal against the polished rod 104. As shown, the polypack seal 300 may have a symmetrical profile and include a beveled lip 302 having an o-ring 304. Referring back to FIG. 2, the polypack seal 300 may correspond to the polypack seal 206 or polypack seal 208. The o-ring 304 may correspond to the o-ring 240 of polypack seal 206 or o-ring 242 of polypack seal 208. The polypack seal 300 may include polyurethane with a BUNA-N (Nitrile) o-ring. While polypack seal 206 and polypack seals 208 are provided as example elements for sealing the housing 210 against the polished rod 104, any ring or disk element may be used such as a disk of elastomeric material (e.g., up to an inch thick or more) with the polished rod 104 in the middle FIG. 4 illustrates a cross-section of the stuffing box 106 having a polypack seal 206 and one or more other sealing elements. The polypack seal 206 may be implemented along with one or more sealing elements, such as a wiper seal 402 (e.g., polyurethane) and a buffer seal 408 (e.g., a polytetrafluoroethylene (PTFE) with a BUNA-N (Nitrile) o-ring). A wiper seal is an axial seal that creates a seal while allowing a reciprocating shaft (e.g., polished rod 104) to pass through the seal's inner bore. A wear ring 420 (e.g., PTFE) may also be used as a sealing element, as shown. The wear ring may guide the polished rod 104 and help to absorb transverse forces.

A steel housing 406 may be disposed between a flexible membrane 411 and the polished rod 104. The steel housing 406 may correspond to the housing 210 described with respect to FIG. 2. The steel housing 406 may include ridges to support the wiper seal 402, polypack seal 206, buffer seal 408, and wear ring 420. Flexible membrane 411 (e.g., a molded rubber including BUNA-N) may be disposed between the flanges 202, 204 and the housing 406. For example, the flexible membrane 411 may include an indention 450 in which a portion of the steel housing 406 fits such that the steel housing 406 is held in place against polished rod 104. The flanges 202, 204 may also be referred to as a stuffing box housing. The stuffing box housing (e.g., flanges) may be implemented with openings for fastening via bolts, in some implementations.

Figure 5:
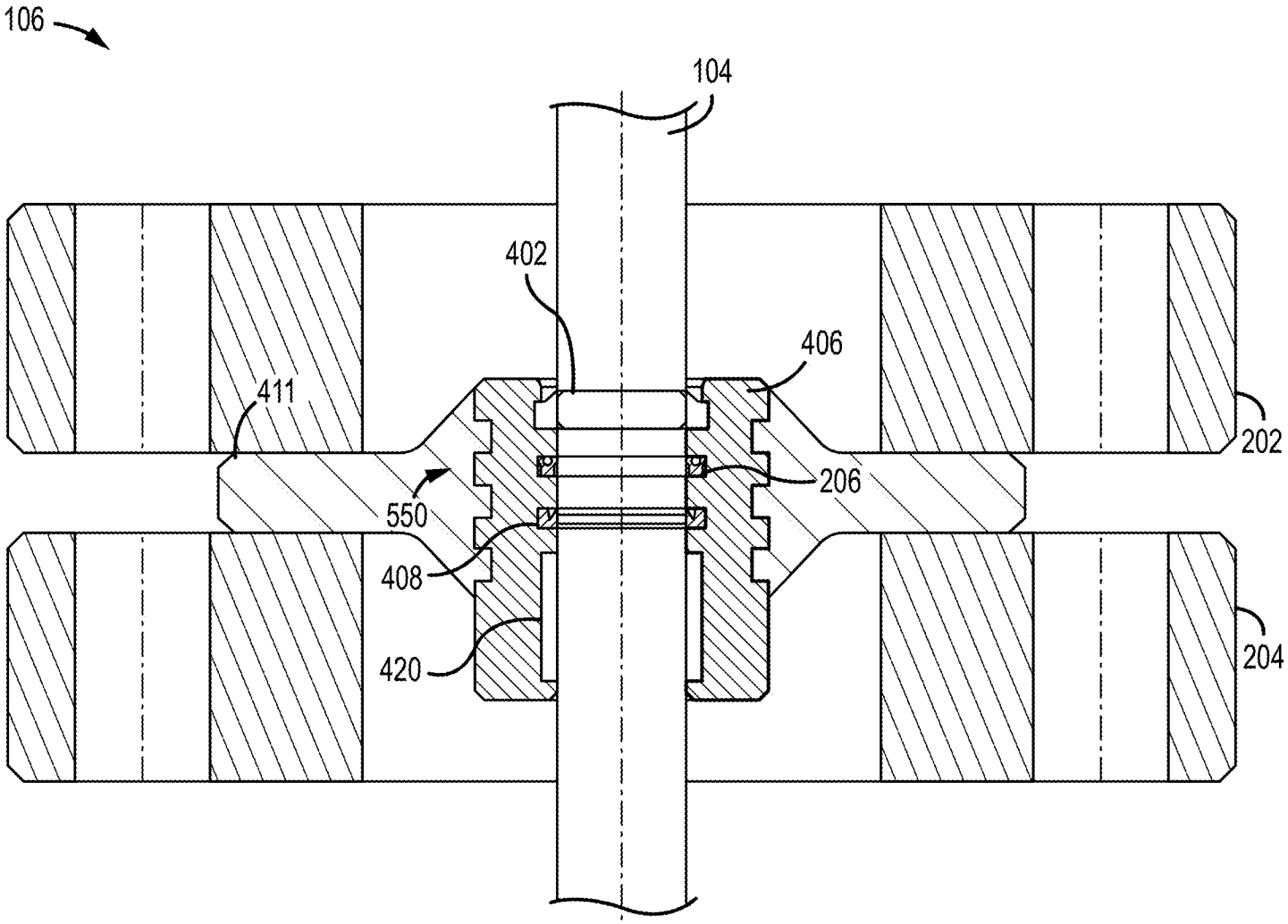
FIG. 5 illustrates a cross-section of a stuffing box having a steel housing with indentions to fit a flexible membrane.

FIG. 5 illustrates a cross-section of the stuffing box 106 having a steel housing 406 with indentions to fit a rubber housing (e.g., flexible membrane 411). For example, flexible membrane 411 may include rectangular protrusions 550 that fit into rectangular indentions of the steel housing 406, preventing (or at least reducing) vertical movement of the steel housing 406 with respect to flexible membrane 411 or flanges 202, 204.

Figure 6A:
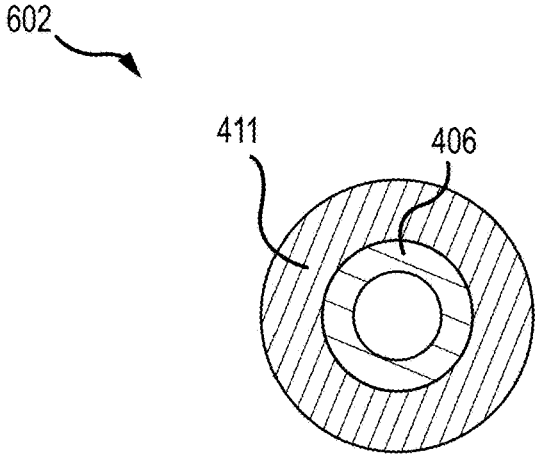
FIGS. 6A, 6B, and 6C illustrate top views of example stuffing boxes, in accordance with certain aspects of the present disclosure.
Figure 6B:
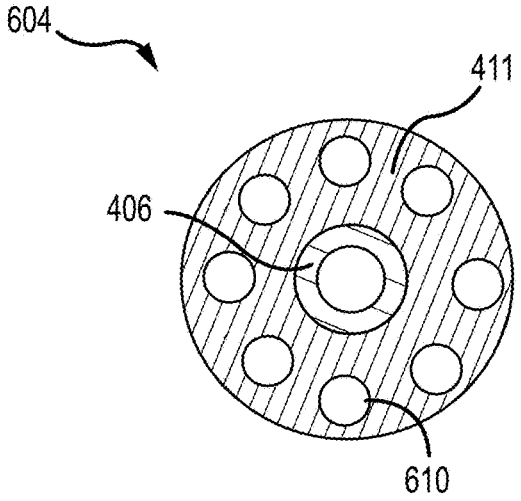
Figure 6C:
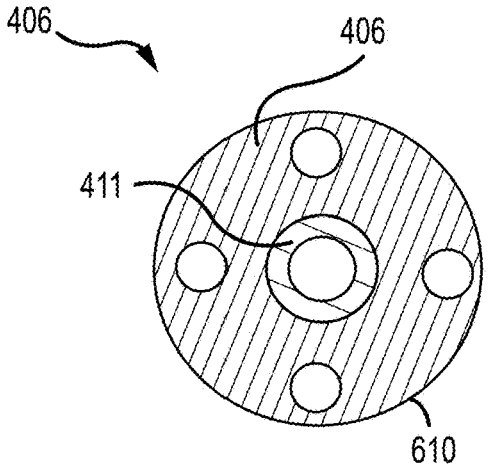

FIGS. 6A, 6B, and 6C illustrate top views of example stuffing boxes 602, 604, 606, respectively, in accordance with certain aspects of the present disclosure. As shown, the stuffing box 602 includes the housing 406 that is surrounded by the membrane 411. In some implementations, the membrane 411 may be connected (e.g., molded) to the housing 406, as described herein. As shown in FIGS. 6B and 6C, the membrane 411 may include openings (e.g., opening 610) through which bolts may be placed. The bolts may be placed through openings of a top flange, through the membrane 411, and through openings of a bottom flange, as described in more detail herein. Any number of openings (e.g., bolt holes) may be used, such as eight openings as shown in FIG. 6B or four openings as shown in FIG. 6C. The diameter of the openings in the membrane 411 may be greater than the openings in the top and bottom flanges, allowing the membrane 411 to move around the bolts.

Figure 7:
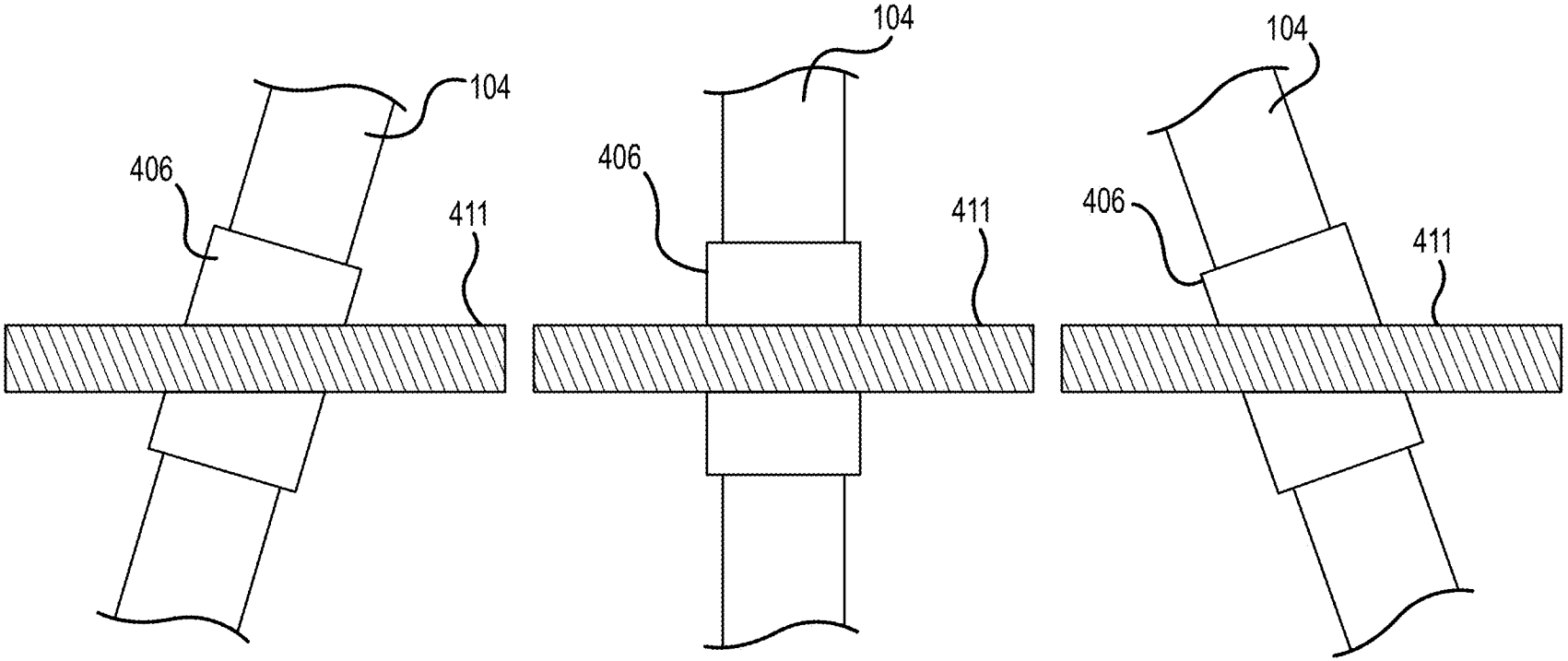
FIG. 7 illustrates a housing and polished rod tilting with respect to a membrane, in accordance with certain aspects of the present disclosure.

FIG. 7 illustrates the housing 406 and polished rod 104 tilting with respect to the membrane 411, in accordance with certain aspects of the present disclosure. The membrane 411 allows the fixed housing 406 to move and tilt in different directions with the polished rod. In this manner, the flexible membrane 411 reduces stress on the seal package (e.g., polypack seal 206), polished rod 104, and associated equipment.

Figure 8A:
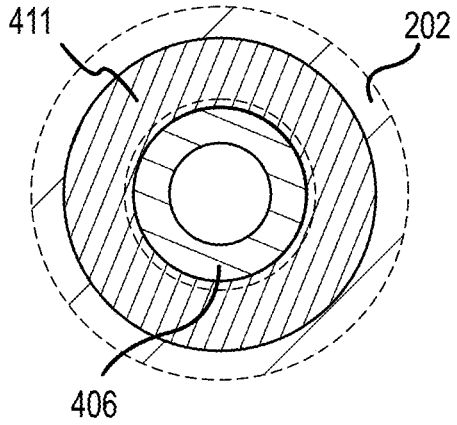
FIGS. 8A, 8B, and 8C illustrate stuffing boxes including respective flanges, in accordance with certain aspects of the present disclosure.
Figure 8B:
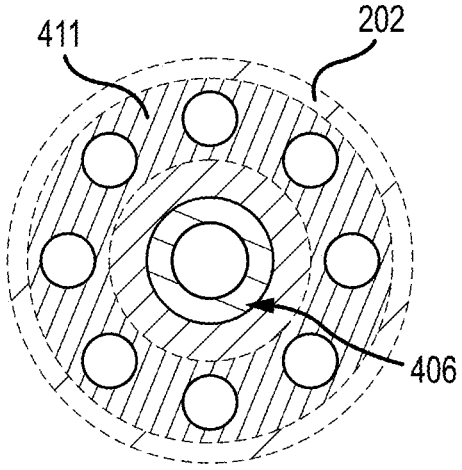
Figure 8C:
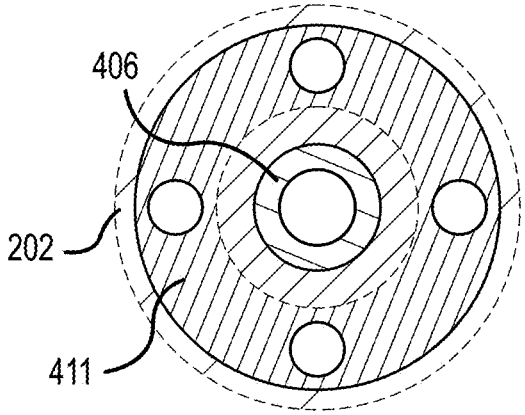

FIGS. 8A, 8B, and 8C illustrate the stuffing boxes 602, 604, 606 including respective flanges (e.g., flange 202), in accordance with certain aspects of the present disclosure. As shown, the stuffing box 602 may include top and bottom flanges (e.g., retainers), with the membrane 411 being between the top and bottom flanges. As shown in FIGS. 8B and 8C, the membrane 411 and flanges may include openings though which bolts may be placed for fastening the flanges and the membrane 411 against the housing 406 as described.

Figure 9:
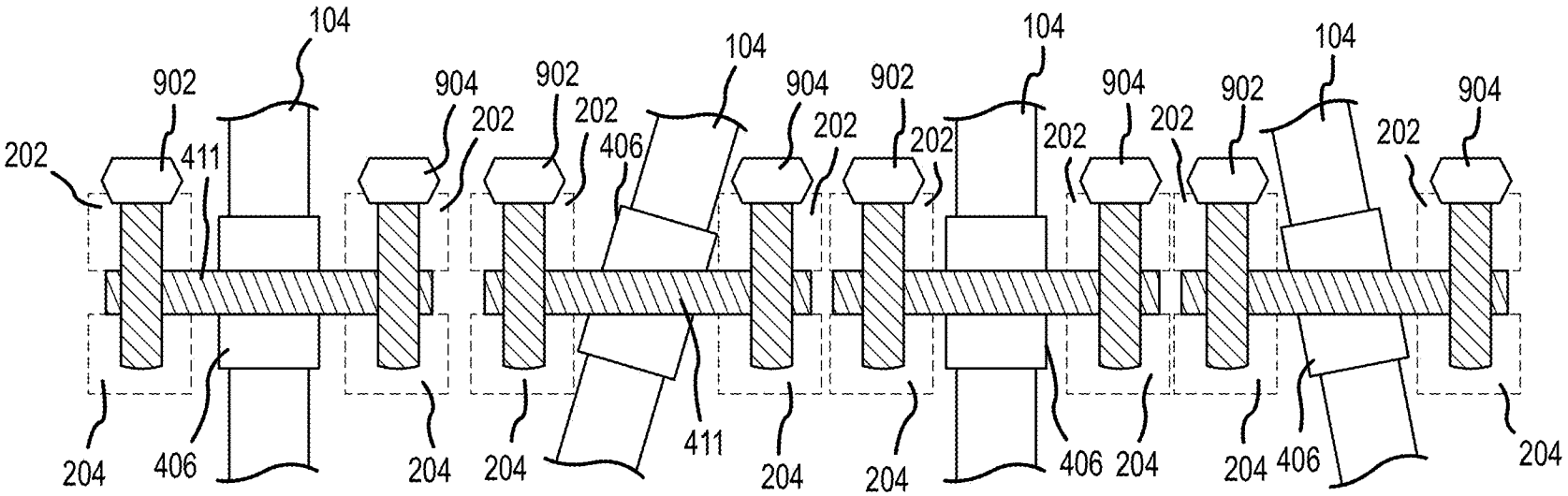
FIG. 9 is a cross-section of a stuffing box showing a housing and polished rod tilting with respect to a membrane, in accordance with certain aspects of the present disclosure.

FIG. 9 is a cross section of a stuffing box showing the housing 406 and polished rod 104 tilting with respect to the membrane 411, in accordance with certain aspects of the present disclosure. As shown, bolts 902, 904 may be placed through respective openings in the flange 202, respective openings in the membrane 411, and respective openings in the flange 204. As shown, the polished rod 104 and the housing 406 may tilt with respect to the membrane 411. In other words, the membrane is composed of flexible material (e.g., rubber), that allows the polished rod 104 and housing 406 to tilt, reducing stress on the seal package (e.g., polypack seal 206), polished rod (e.g., polished rod 104), and associated equipment. In some aspects, the flange 204 may include threading for connection with the respective bolt, as shown. In other aspects, the bolt may be placed through an opening in flange 204 and fastened with a nut (not shown) below the flange.

Figure 10:
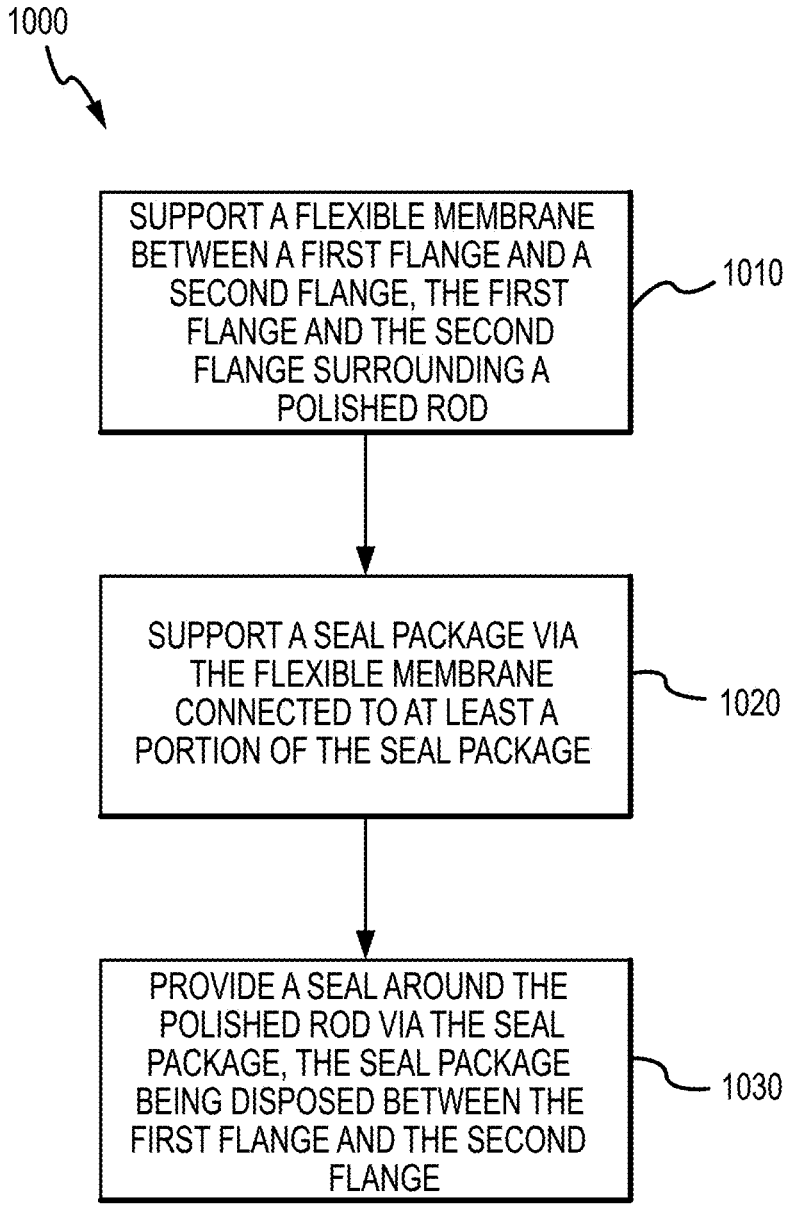
FIG. 10 is a flow diagram illustrating example operations for providing a seal for a polished rod, in accordance with certain aspects of the present disclosure.

FIG. 10 is a flow diagram illustrating example operations 1000 for providing a seal for a polished rod, in accordance with certain aspects of the present disclosure. The operations 1000 may be performed by a stuffing box, such as the stuffing box 106.

The operations 1000 include, at block 1010, with the stuffing box supporting a flexible membrane (e.g., flexible membrane 411) between a first flange (e.g., flange 202) and a second flange (e.g., flange 204), the first flange and the second flange surrounding a polished rod (e.g., polished rod 104).

At block 1020, the stuffing box supports a seal package via the flexible membrane connected (e.g., molded) to at least a portion of the seal package. In some aspects, the flexible membrane may be further connected to a portion of the first flange and a portion of the second flange. For example, the flexible membrane 411 has a curved shape portion 250 to fit between the flanges 202, 204 and the polished rod 104 such that the flanges 202, 204 support the flexible membrane 411 against the polished rod 104, as described with respect to FIG. 2. In some aspects, the seal package includes a polypack seal element (e.g., the polypack seal 206). In some aspects, the seal package comprises an o-ring.

The flexible membrane includes an indention in some aspects, as shown in FIG. 2. The seal package may be supported via the indention of the flexible membrane.

In some aspects, the seal package includes a seal element (e.g., polypack seal 206) configured to surround and connect to the polished rod, and a housing (e.g., housing 406) surrounding the seal element. In this case, supporting the seal package may include supporting the housing of the seal package via the flexible membrane. The flexible membrane may include an indention (e.g., indention 450 of FIG. 4), and the housing may be supported via the indention of the flexible membrane. In some aspects, the flexible membrane includes multiple protruding portions (e.g., protrusions 550 of FIG. 5, also referred to herein as a protruding piece), and the housing may be supported via the multiple protruding portions of the flexible membrane.

At block 1030, the stuffing box provides a seal around the polished rod via the seal package, the seal package being disposed between the first flange and the second flange.

In the present disclosure, the methods disclosed may be implemented as sets of instructions. Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, aspects in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A stuffing box for oil and gas operations, the stuffing box comprising:

a first flange configured to surround a polished rod;

a second flange configured to surround the polished rod;

a seal package disposed between the first flange and the second flange, the seal package being configured to surround and connect to the polished rod, the seal package including one or more seals and a housing surrounding the one or more seals, the housing including one or more ridges supporting the one or more seals; and a flexible membrane surrounding the seal package, the flexible membrane being connected to at least a portion of the housing.

2. The stuffing box of claim 1, wherein the flexible membrane is further connected to a portion of the first flange and a portion of the second flange.

3. The stuffing box of claim 1, wherein the one or more seals comprises a polypack seal.

4. The stuffing box of claim 1, wherein the one or more seals comprises an o-ring.

5. The stuffing box of claim 1, wherein the flexible membrane comprises a rubber disk.

6. The stuffing box of claim 1, wherein the one or more seals are configured to surround and connect to the polished rod; and wherein the housing is disposed between the flexible membrane and the one or more seals.

7. The stuffing box of claim 6, wherein the housing comprises a steel housing.

8. The stuffing box of claim 6, wherein the flexible membrane comprises an indention, and wherein a protruding piece of the housing is disposed in the indention of the flexible membrane.

9. The stuffing box of claim 6, wherein the housing comprises multiple indentions, and wherein protruding portions of the flexible membrane are disposed in the multiple indentions.

10. The stuffing box of claim 1, wherein the flexible membrane is configured to support the polished rod while allowing the polished rod to tilt with respect to the flexible membrane.

11. The stuffing box of claim 1, wherein the one or more seals include a wiper seal between the first flange and the second flange, the wiper seal being configured to surround and connect to the polished rod.

12. The stuffing box of claim 1, wherein the one or more seals include a buffer seal between the first flange and the second flange, the buffer seal being configured to surround and connect to the polished rod.

13. The stuffing box of claim 1, wherein the one or more seals include a wear ring between the first flange and the second flange, the wear ring being configured to surround and connect to the polished rod.

14. A method comprising:

supporting a flexible membrane between a first flange and a second flange, the first flange and the second flange surrounding a polished rod in connection with oil and gas operations;

supporting a seal package via the flexible membrane, the seal package including one or more seals and a housing surrounding the one or more seals, the housing including one or more ridges supporting the one or more seals, the flexible membrane connected to at least a portion of the housing; and providing the seal package around the polished rod, the seal package being disposed between the first flange and the second flange.

15. The method of claim 14, wherein the flexible membrane is further connected to a portion of the first flange and a portion of the second flange.

16. The method of claim 14, wherein the one or more seals comprises a polypack seal.

17. The method of claim 14, further comprising supporting the polished rod via the flexible membrane while allowing the polished rod to tilt with respect to the flexible membrane.

18. The method of claim 14, wherein the one or more seals surround and connect to the polished rod; and wherein supporting the seal package comprises supporting the housing of the seal package via the flexible membrane.

19. The method of claim 18, wherein the flexible membrane comprises an indention, and wherein the housing is supported via the indention of the flexible membrane.

20. The method of claim 18, wherein the flexible membrane comprises multiple protruding portions, and wherein the housing is supported via the multiple protruding portions of the flexible membrane.

* * * * *